US011161157B2

(12) United States Patent
Wu

(10) Patent No.: US 11,161,157 B2
(45) Date of Patent: Nov. 2, 2021

(54) UNDERWATER CAVITATION JET CLEANING SYSTEM

(71) Applicant: Etenl Marine Eco-Technology (Holdings) Limited, Hong Kong (HK)

(72) Inventor: Min Wu, Hong Kong (HK)

(73) Assignee: ETENL MARINE ECO-TECHNOLOGY (HOLDINGS) LIMITED, Hong Kong (HK)

( * ) Notice: Subject to any disclaimer, the term of this patent is extended or adjusted under 35 U.S.C. 154(b) by 15 days.

(21) Appl. No.: 16/476,844

(22) PCT Filed: Dec. 28, 2017

(86) PCT No.: PCT/CN2017/119299
§ 371 (c)(1),
(2) Date: Jul. 9, 2019

(87) PCT Pub. No.: WO2018/223673
PCT Pub. Date: Dec. 13, 2018

(65) Prior Publication Data

US 2020/0122203 A1 Apr. 23, 2020

(30) Foreign Application Priority Data

Jun. 6, 2017 (CN) ..... 201710417541.8

(51) Int. Cl.
*B08B 3/02* (2006.01)
*B08B 3/10* (2006.01)
(Continued)

(52) U.S. Cl.
CPC ..... *B08B 3/102* (2013.01); *B08B 3/024* (2013.01); *B08B 3/12* (2013.01); *B63B 59/08* (2013.01);
(Continued)

(58) Field of Classification Search
CPC ..... B08B 3/02; B08B 3/024; B08B 3/026; B08B 3/028; B08B 3/102; B08B 3/12;
(Continued)

(56) References Cited

U.S. PATENT DOCUMENTS 4,444,146 A * 4/1984 Witz ..... B08B 3/12 114/222
2005/0139697 A1* 6/2005 Pivovarov ..... B05B 12/002 239/399

FOREIGN PATENT DOCUMENTS

CN 203578049 U 5/2014
CN 105234019 A 1/2016
(Continued)

*Primary Examiner* — David G Cormier
(74) *Attorney, Agent, or Firm* — Sinorica, LLC

(57) ABSTRACT

An underwater cavitation jet cleaning system provided with an automatic metering feeder for cleaning solution organically integrates a cavitation jet technology with the improvement of cleaning solutions, which can not only increase bubbles can be during jet, but also is beneficial for removing hull dirt. An eddy segment of a nozzle is arranged as a spiral passage, and the eddy segment is gradually reduced from a water inlet to a water outlet, so that a speed of fluid becomes further faster. A volume of an in-pipe chamber of a barrel is different, and the fluid is pulsed while flowing through the barrel, so that the fluid is finally ejected from the nozzle of a cleaning gun, which efficiently improves the cavitation rate, and increases the generation of cavitation nucleus.

7 Claims, 7 Drawing Sheets

(51) Int. Cl.
*B08B 3/12* (2006.01)
*B63B 59/08* (2006.01)

(52) U.S. Cl.
CPC ... *B08B 2203/007* (2013.01); *B08B 2203/027* (2013.01); *B08B 2203/0276* (2013.01)

(58) Field of Classification Search
CPC ..... B08B 9/0433; B08B 9/0813; B08B 9/093; B08B 9/0936; B08B 2203/02; B08B 2203/007; B08B 2203/0276; B08B 2203/0288; B08B 2209/005; B63B 59/06; B63B 59/08; B63B 59/082; B63B 59/085; B63B 59/087
See application file for complete search history.

(56) References Cited

FOREIGN PATENT DOCUMENTS

| | | | |
|---|---|---|---|
| CN | 205602073 | U | 9/2016 |
| CN | 205732098 | U | 11/2016 |
| CN | 206813267 | U | 12/2017 |
| KR | 20160136656 | A | 11/2016 |
| WO | WO2017053136 | A1 | 3/2017 |

* cited by examiner

UNDERWATER CAVITATION JET CLEANING SYSTEM

TECHNICAL FIELD

The present invention relates to the field of underwater cleaning technology, and more particularly, to an underwater cavitation jet cleaning system.

BACKGROUND

After large ships have navigated over many years, a thick dirt layer is formed on hulls below a waterline thereof, and a large area of corrosion is also inevitably generated as well. Therefore, when the large ships are overhauled, old coating, scaling and ruse of the hull are generally required to remove, then new paint is coated, so as to guarantee the normal navigation of the ship and prolong the service life thereof. In recent years, with the development of pressured water jet technology, this technology has been preferably applied in the ship industry. The working principle of the technology is as follows: a pressure of ordinary water is increased to 40 to 250 MPa via a high pressure water pump, a flow of a single gun is about 20 to 39 L/min, the ordinary water is ejected from a nozzle, to form a ultrahigh pressure water jet or an abrasive water jet. The coating, scaling, rust and paint can be rapidly removed clean via powerful impact force, erosion force and stripping capability of water jet. However, although the prior art can increase the pressure of the water flow, the current cavitation jet technology achieves a bottleneck as the water pressure of the apparatus cannot be blindly improved due to the technical limitations of the pump and the gun. In this way, how to further improve the cavitation jet effect, increase the underwater working efficiency and cleaning effect is the problem that those skilled in the art are studying to explore.

Therefore, it is particularly important to provide an underwater cavitation jet cleaning system to improve the cavitation jet effect and increase the underwater cleaning working efficiency and cleaning effect in view of the existing problems in the prior art.

SUMMARY

The present invention aims at providing an underwater cavitation jet cleaning system to improve the cavitation jet effect and increase the underwater cleaning working efficiency and cleaning effect in order to increase the shortages in the prior art.

The object of the present invention is achieved by the following technical solution:

An underwater cavitation jet cleaning system comprises a supporting structure, an automatic metering feeder for cleaning solution, and a power unit, a booster pump, a filter, a plunger pump and a high-pressure hose connected in sequence, wherein a water outlet end of the high-pressure hose is attachable to a cleaning gun or a cleaning plate; the automatic metering feeder for cleaning solution is communicated with a water inlet of the plunger pump, and an infusion pipe of the automatic metering feeder for cleaning solution is installed with a one-way check valve, and the automatic metering feeder for cleaning solution and the power unit are controlled by a central controller to operate respectively.

A sprayer of the cleaning gun is provided with a nozzle, the nozzle is opened with a diversion hole, the diversion hole comprises an inflow passage and an eddy segment, the eddy segment is arranged as a spiral passage, and the eddy segment is gradually reduced from the water inlet to a water outlet; micro-grade crystallized silicon dioxide particles are dispersed on a surface of an inner wall of the nozzle, and the silicon dioxide particles are protruded out of the surface of the inner wall of the nozzle.

The sprayer of the cleaning gun is provided with a rotatable waterproof jacket, a miniature vibrator, two conducting slabs and a power supply for vibration are arranged in the waterproof jacket, the two conducting slabs are connected with electrodes of the miniature vibrator respectively, wherein the first conducting slab contacts with a negative pole of the power supply, the second conducting slab is fixed at one end of the waterproof jacket, the miniature vibrator is operated when the second conducting slab contacts with a positive pole of the power supply due to the rotation of the waterproof jacket; and an organ pipe is arranged between the sprayer and a barrel of the cleaning gun.

One end of the barrel of the cleaning gun close to the sprayer is provided with an automatic heating unit, and the automatic heating unit is composed of a temperature sensor, an electric hot plate and a microchip and is connected with the power supply.

An in-pipe passage of the barrel is formed by communicating a plurality of spherical chambers, and a diameter of a connecting portion of two adjacent spherical chambers is smaller than a diameter of the spherical chamber.

The cleaning plate comprises a hand-push frame, a shell, a hollow revolving shaft, an input pipe and a jet pipe, the hand-push frame is connected with the shell, the hollow revolving shaft is rotatably installed in the shell, the hollow revolving shaft is provided with a diversion passage and an inner wall of the diversion passage is provided with a plurality of arc-formed strips, the high-pressure hose is assembled with and communicated with the input pipe, the input pipe is communicated with an upper portion of the diversion passage, a lower portion of the diversion passage is communicated with the jet pipe, and a bottom thereof is provided with the sprayer.

Preferably, a lower portion of the hollow revolving shaft is fixedly connected with a baffling hood, and the sprayer at the bottom of the hollow revolving shaft is located inside the baffling hood.

More preferably, an inner wall of the baffling hood is provided with a plurality of arc-shaped plates, and the plurality of arc-shaped plates are uniformly arranged along a peripheral direction.

Preferably, the jet pipe is provided with a high-pressure nozzle, an included angle between the high-pressure nozzle and the jet pipe in a horizontal direction is 120° to 150°, and an included angle between the high-pressure nozzle and the jet pipe in a vertical direction is 130° to 170°.

Preferably, the shell is further provided with an ultrasonic generator, a plurality of jet pipes are provided, each jet pipe is provided with a flow control valve, and both the flow control valve and the ultrasonic generator are controlled by the central controller to operate.

Preferably, the underwater cavitation jet cleaning system further comprises a pressure control system, the pressure control system is provided with a plurality of transducers for testing a water pressure, a signal transmission line and a plurality of electromagnetic valves, the nozzle of the cleaning gun and the high-pressure nozzle of the cleaning plate are provided with the transducer and the electromagnetic valves respectively, and the transducer and the electromagnetic valve are connected via the signal transmission line and the central controller.

Preferably, a detachable grid network is arranged at the bottom of the shell of the cleaning plate.

Preferably, the automatic metering feeder for cleaning solution is internally provided with the cleaning solution containing the following components:

| | |
|---|---|
| palm kernel oil fatty acid amide propyl betaine | 1.0-3.0%, |
| coconut fatty acid diethanol amide | 2.0-3.0%, |
| glycyrrhetinic acid stearate | 1.0-3.0%, |
| dodecyl glucoside | 1.5-5.0%, |
| sodium N-dodecyl-β-aminopropionate | 2.0-4.0%, |
| N-acylamino acid | 1.5-3.5%, |
| N-dihydroxyethyl dodecyl amide | 2.0-6.0%, |
| sodium dodecyl allyl sulfosuccinate | 1.5-2.0%, |
| sodium citrate | 1.0-2.5%, |
| maleic acid | 1.0-2.0%, |
| ethanol | 6.0-12%, |
| ethylene glycol | 3.0-6.0%, and |
| the remaining being water. | |

More preferably, a preparation method for the cleaning solution comprises the following steps of:

(1) in an electric mixer, putting deionized water as well as palm kernel oil fatty acid amide propyl betaine and coconut fatty acid diethanol amide into a reaction kettle in proportion according to formula, stirring until dissolving completely, adding dodecyl glucoside, N-acylamino acid and sodium dodecyl allyl sulfosuccinate in the reaction kettle at a revolving speed of 400 rpm, heating to 40° C., and dispersing for 5 min;

(2) adding a mixed solution of ethanol and ethylene glycol into glycyrrhetinic acid stearate, and stirring until dissolving completely at a revolving speed of 800 rpm; and (3) in an ice-cold bath condition, ultrasonically mixing the solution of (1) and (2), adding with N-dihydroxyethyl dodecyl amide, sodium N-dodecyl-β-aminopropionate, sodium citrate and maleic acid, and standing for 1 h.

The present invention has the advantageous effects that:

An underwater cavitation jet cleaning system provided with an automatic metering feeder for cleaning solution organically integrates a cavitation jet technology with the improvement of cleaning solutions, which can not only increase bubbles during jet, but also is beneficial for removing hull dirt. The eddy segment of the nozzle of the cleaning gun is arranged as a spiral passage, the fluid becomes the spiral eddy after passing through the spiral passage at the same time, the inside of the eddy forms a low pressure area, and a high-speed revolved vortex is formed when the high-pressure fluid is ejected from the nozzle. As a result, not only the cavitation rate is very high, but also the surrounding water flows are flowed and combined into a bigger vortex, so as to activate a mass of bubbles (cavitation nucleuses). The bubbles cause powerful microjet impact on the cleaned ship surface at the moment of cracking. Due to the special arrangement of the nozzle, the flow speed of the near-wall micro jet can reach 90 to 185 m/s when the bubbles generated by the cleaning gun are cracked, the times of the microjet impact applied to the surface is about 100-1000 times/(s·cm$^2$), which effectively cleans hard dirt and attachments. In the present invention, an in-pipe passage of the barrel of the cleaning gun is formed by communicating a plurality of spherical chambers, and a diameter of a connecting portion of two adjacent spherical chambers is smaller than a diameter of the spherical chamber. A volume of an in-pipe chamber of the barrel is different, and the fluid is pulsed while flowing through the barrel, so that the fluid finally ejected from the nozzle of a cleaning gun, which efficiently improves the cavitation rate, and increases the generation of cavitation nucleus.

The cleaning gun is further provided with a miniature vibrator, two conducting slabs and a power supply for vibration. The electrodynamic type miniature vibrator can enable the cleaning gun to eject the water flow to form an intermittent pulse eddy segment, which increases the generation of cavitation nucleus. An organ pipe is arranged between the sprayer and the barrel to play a role in diversion and buffer, which reduces the effect of the vibration of the sprayer on the barrel. One end of the barrel close to the sprayer is provided with an automatic heating unit. When a water temperature is lower than a preset value, the water in the barrel is heated by an electric hot plate to reach the set temperature, such as 27° C. to 38° C. At this temperature, the optimal cavitation effect can be obtained by the water media if the viscosity and surface tension thereof are omitted. A hollow revolving shaft of a cleaning plate is provided with a diversion passage and a wall of the diversion passage is provided with a plurality of arc-formed strips, so that the water flow forms the vortex in the hollow revolving shaft to eject from the lower end, and then the high-speed revolved fluid is subjected to jet cavitation. In addition, the hollow revolving shaft jets the fluid downward, the fluid also applies a reverse thrust to the cleaning plate, which is beneficial for the cleaning plate to float on water. In this way, a shell of the cleaning plate is reduced to have huge volume due to the arrangement of a mass of light objects such as foam inside the shell.

BRIEF DESCRIPTION OF THE DRAWINGS

The present invention is further described with reference to the drawings, but is not limited to the contents in the drawings.

FIG. 1 to FIG. 7 comprise as follows:

1 refers to supporting structure, 2 refers to power unit, 3 refers to booster pump, 4 refers to filter, 5 refers to plunger pump, 6 refers to high-pressure hose, 7 refers to cleaning gun, 7-1 refers to barrel, 7-2 refers to chamber, 7-31 refers to inflow passage, 7-32 refers to eddy segment, 7-4 refers to waterproof jacket, 7-5 refers to power supply, 7-6 refers to miniature vibrator, 7-7 refers to organ pipe, 7-8 refers to temperature sensor, 7-9 refers to electric hot plate, 7-10 refers to automatic heating unit, 8 refers to cleaning plate, 8-1 refers to hand-push frame, 8-2 refers to shell, 8-3 refers to hollow revolving shaft, 8-31 refers to diversion passage, 8-32 refers to arc-shaped strip, 8-33 refers to sprayer, 8-4 refers to input pipe, 8-5 refers to jet pipe, 8-51 refers to high-pressure nozzle, 8-6 refers to baffling hood, 8-61 refers to arc-shaped plate, 8-7 refers to grid network, and 9 refers to automatic metering feeder for cleaning solution, and 10 refers to controller.

DETAILED DESCRIPTION

The present invention will be further described with reference to the embodiments hereunder.

Embodiment 1

Figure 1:
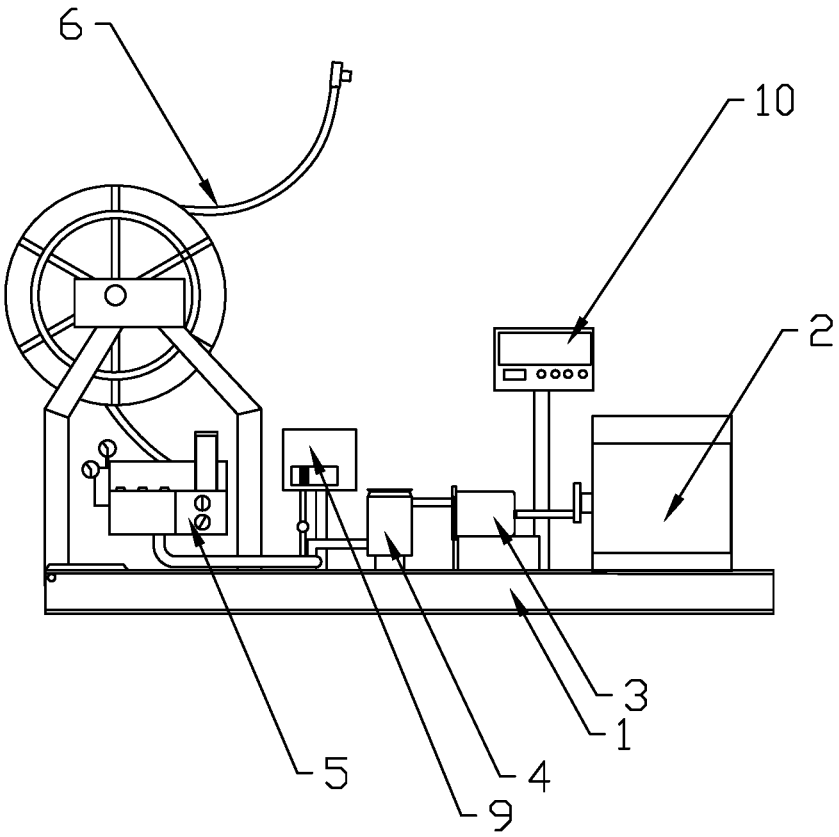
FIG. 1 is a structural schematic diagram of an embodiment of an underwater cavitation jet cleaning system of the present invention.
Figure 2:
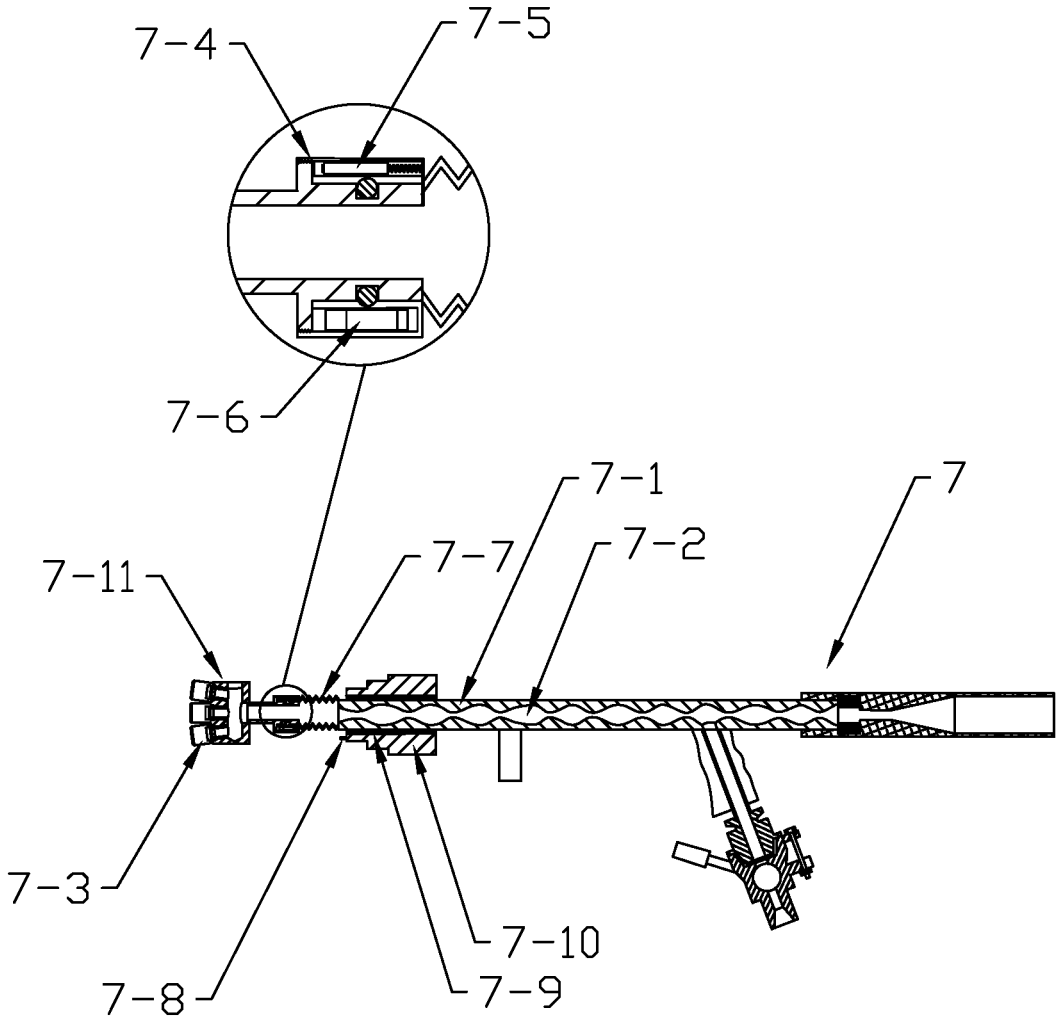
FIG. 2 is another angle structural schematic diagram of one embodiment of the underwater cavitation jet cleaning system of the present invention.
Figure 3:
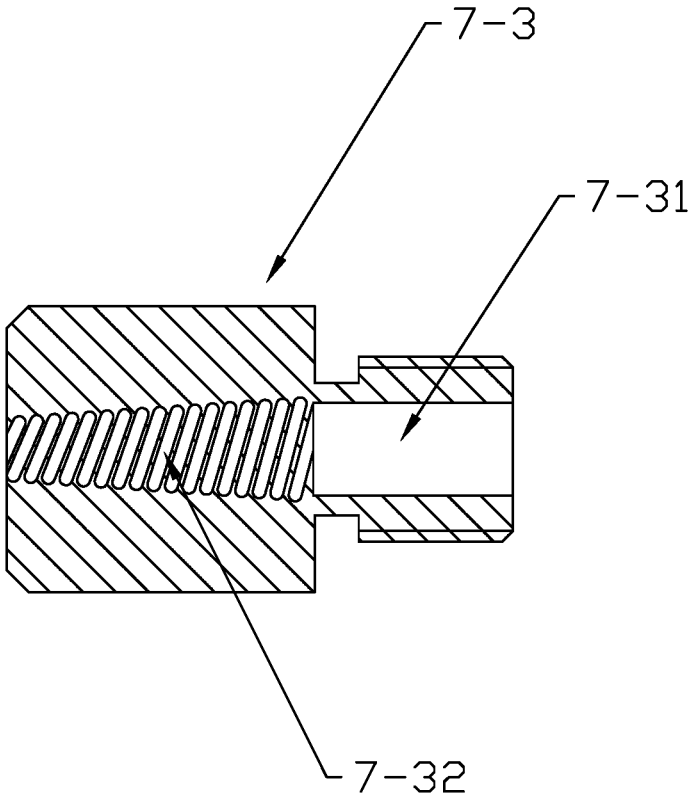
FIG. 3 is a structural schematic diagram of a nozzle of one embodiment of the underwater cavitation jet cleaning system of the present invention.
Figure 4:
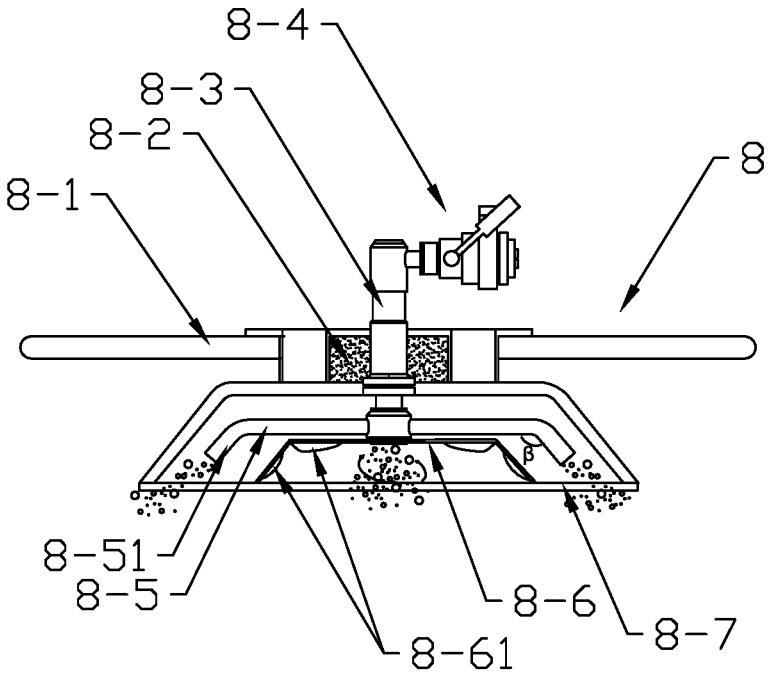
FIG. 4 is a structural schematic diagram of a cleaning plate of one embodiment of the underwater cavitation jet cleaning system of the present invention.
Figure 5:
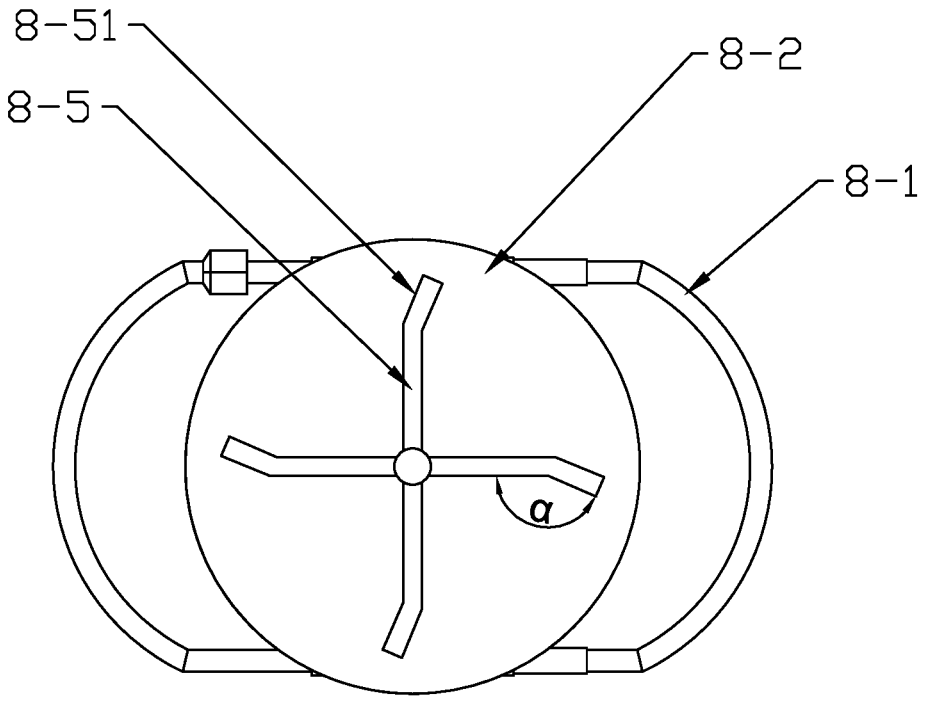
FIG. 5 is a structural schematic diagram of removing a baffling hood from the bottom of the cleaning plate of one embodiment of the underwater cavitation jet cleaning system of the present invention.
Figure 6:
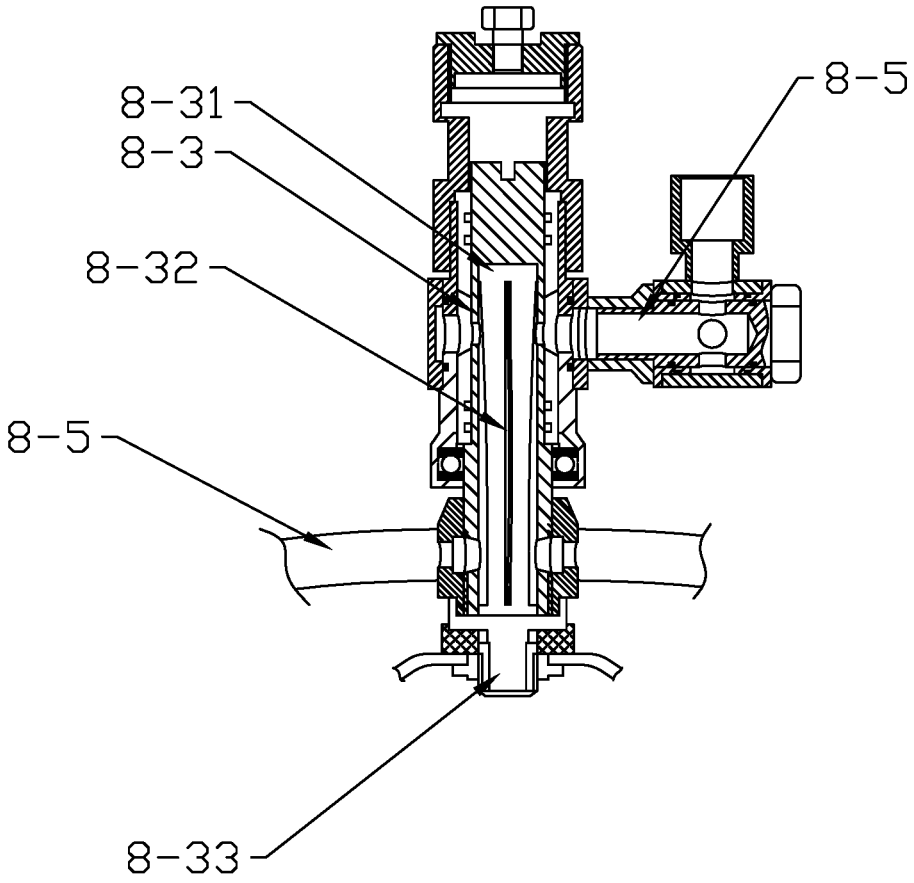
FIG. 6 is a structural schematic diagram of an input pipe, a hollow revolving shaft and a jet pipe of one embodiment of the underwater cavitation jet cleaning system of the present invention.
Figure 7:
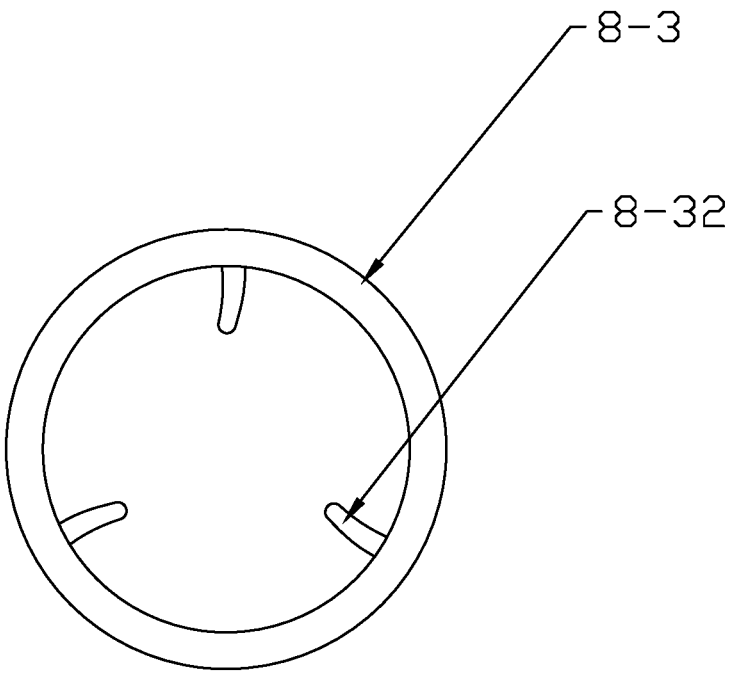
FIG. 7 is a structural schematic diagram of the hollow revolving shaft of one embodiment of the underwater cavitation jet cleaning system of the present invention.

As shown in FIG. 1 to FIG. 7, an underwater cavitation jet cleaning system of this embodiment comprises a supporting structure 1, an automatic metering feeder 9 for cleaning solution, and a power unit 2, a booster pump 3, a filter 4, a plunger pump 5 and a high-pressure hose 6 connected in sequence, wherein the power unit 2 provides power for the booster pump 3 and the plunger pump 5. A water outlet end of the high-pressure hose 6 can be connected with a cleaning gun 7 or a cleaning plate 8 according to the need.

An in-pipe passage of a barrel 7-1 of the cleaning gun 7 is formed by communicating a plurality of spherical chambers 7-2, a diameter of a connecting portion of two adjacent spherical chambers 7-2 is smaller than a diameter of the spherical chamber 7-2, a nozzle 7-3 of the barrel 7-1 of the cleaning gun 7 is opened with a diversion hole, the diversion hole comprises an inflow passage 7-31 and an eddy segment 7-32, wherein the eddy segment 7-32 is arranged as a spiral passage, and the eddy segment is gradually reduced from a water inlet to a water outlet. Micro-grade crystallized silicon dioxide particles are dispersed on a surface of an inner wall of the nozzle 7-3 to increase the formation of small cavitation nucleus, and the silicon dioxide particles are protruded out of the surface of the inner wall of the nozzle. The silicon dioxide on the surface of the inner wall of the nozzle 7-3 can improve the abrasion resistance and high-pressure impact resistance of the nozzle, so as to prolong the service life of the nozzle 7-3 at a high flow speed and under a high pressure.

The cleaning gun 7 of the embodiment is further provided with a miniature vibrator 7-6, two conducting slabs, a waterproof jacket 7-4 and a power supply 7-5 for vibration, the waterproof jacket 7-4 can be rotatably installed in the sprayer 7-11, the waterproof jacket 7-4 is connected with the sprayer 7-11 in a threaded way in this embodiment, the waterproof jacket 7-4 is part of a rotary switch, the miniature vibrator 7-6 and the power supply 7-5 are installed in the waterproof jacket 7-4, one conducting slab contacts with a negative pole of the power supply 7-5, the other conducting slab is fixed at one end of the waterproof jacket 7-4 and when the waterproof jacket 7-6 rotates towards a pre-set direction to displace, the conducting slab can move along with it to finally contact with a positive pole of the power supply 7-5, and two conducting slabs are connected with electrodes of the miniature vibrator 7-6 respectively. The mechanical vibration of the miniature vibrator 7-6 is utilized to enhance the underwater cavitation effect of the ejection of the high-pressure water flow, which further improves the cleaning effect. Wherein, the waterproof jacket 7-4 plays a role in both waterproof sealing and switching in/off, so that an underwater cleaning operator can manually rotate to open or close the miniature vibrator 7-6 according to the needs. The structure is simple and the flexibility is high. An organ pipe 7-7 is arranged between the sprayer and the barrel 7-1 of the cleaning gun 7. The organ pipe 7-7 can play a role in buffering to weaken the vibration of the miniature vibrator 7-6 to the barrel 7-1. At the same time, one end of the barrel 7-1 close to the sprayer is provided with an automatic heating unit 7-10. The automatic heating unit 7-10 is composed of a temperature sensor, an electric hot plate, a microchip (without being shown in figure) and a power supply for heating (without being shown in figure). When the water pressure is lower than the preset value, the water in the barrel is heated by the electric hot plate to reach the set temperature, so that the preferable cavitation effect is obtained.

The cleaning plate 8 comprises a hand-push frame 8-1, a shell 8-2, a hollow revolving shaft 8-3, an input pipe 8-4 and a jet pipe 8-5, the hand-push frame 8-1 is connected with the shell 8-2, the hollow revolving shaft 8-3 is rotatably installed in the shell 8-2, the hollow revolving shaft 8-3 is provided with a diversion passage 8-31 and a wall of the diversion passage 8-31 is provided with a plurality of arc-formed strips 8-32, a lower end of the diversion passage 8-31 is provided with a sprayer 8-33, the high-pressure hose 6 is communicated with the input pipe 8-4, the input pipe 8-4 and the jet pipe 8-5 are communicated with the diversion passage 8-31 of the hollow revolving shaft 8-3 respectively, a water outlet of the jet pipe 8-5 is provided with a high-pressure nozzle 8-51, the high-pressure nozzle 8-51 is opened with a diversion hole, the diversion hole comprises an inflow passage 7-31 and an eddy segment 7-32, a diameter of the eddy segment 7-32 is gradually reduced from a water inlet to a water outlet, and an inner wall of the eddy segment 7-32 is provided with sunk spiral lines. An included angle $\alpha$ between the high-pressure nozzle 8-51 and the jet pipe 8-5 in a horizontal direction is 120°, 130°, 150° or others, and the angle is regulated according to the practical situation. An included angle $\beta$ between the high-pressure nozzle 8-51 and the jet pipe 8-5 in a horizontal direction is 130°, 150°, 170° or others, and the angle is regulated according to the practical situation. In this embodiment, a plurality of jet pipes 8-5 of the cleaning plate 8 are provided, each jet pipe is provided with a flow control valve, all flow control valve are controlled by the controller 10 respectively. Under the control of the controller 10, and at the same time, the flows ejected by different jet pipes 8-5 are different, the flow speed is different, a reactive thrust of each jet pipe 8-5 is different, but the cleaning plate 8 moves in different directions, so as to realize the automatic movement jet cleaning. In the present embodiment, the shell is also provided with an ultrasonic generator. Although a ultrasonic cleaning machine in these places such as a laboratory is a commonly used cleaning apparatus, the conventional ultrasonic cleaning machine does not need the personnel to keep it, and the articles to be cleaned are put into a rinsing tank. But for the underwater cleaning field of the ship, it is difficult to carry out the ultrasonic cleaning for the underwater cleaning field. The ultrasonic wave is a sound wave with a frequency higher than 20000 Hz. Ultrasonic vibration can cause the movement of substances in the tissue and makes the internal structure of the cell changed, resulting in functional change of cell. When the intensity of ultrasound reaches to a certain extent, it may have some adverse effects on the human body, affecting the health of the personnel who uses the cleaning system underwater to work for a long term. Therefore, the ultrasonic is avoided to as much as possible or the ultrasonic is eliminated by using the apparatus to avoid the adverse effects on the personnel in the prior art. In the present invention, it is possible to provide the ultrasonic generator because the cleaning plate of the present invention does not necessarily need to be manually pushed to move, and the automatic floating and sinking can be realized due to the reactive thrust of the plurality of jet pipes 8-5 and the hollow revolving shaft 8-31.

A lower portion of the hollow revolving shaft 8-3 is fixedly connected with a baffling hood 8-6, and the sprayer 8-33 is located inside the baffling hood 8-6. Such arrangement presents the high-speed spiral jet ejected from the lower end of the hollow revolving shaft 8-3 from generating the vortex, so that the rotational flow and the water flow backwashed from the surface of the ship impacts the jet pipe 8-5 at the lower portion of the cleaning plate 8 to cause damage. In this embodiment, an inner wall of the baffling hood 8-6 is further provided with a plurality of arc-shaped plates 8-61, and the plurality of arc-shaped plates 8-61 are uniformly arranged along a peripheral direction. When the baffling hood 8-6 rotates along with the hollow revolving shaft 8-3, the fluid inside the baffling hood 8-6 attached to the wall to rotate to jointly form dual-vortex with the spiral eddy ejected from the lower end of the hollow revolving shaft 8-3, forming a mass of cavitation nucleuses.

In this embodiment, a detachable grid network 8-7 is arranged at the bottom of the shell 8-2 of the cleaning plate 8 to preventing large-sized foreign matters from entering to damage the jet pipe 8-5, the baffling hood 8-6 and the hollow revolving shaft 8-3.

The underwater cavitation jet cleaning system further comprises a pressure control system, wherein the pressure control system is provided with a plurality of transducers for testing a water pressure, a signal transmission line and a plurality of electromagnetic valves, the nozzle of the cleaning gun and the high-pressure nozzle of the cleaning plate are provided with the transducer and the electromagnetic valves respectively, one water outlet end of the nozzle of the cleaning gun and that of the high-pressure nozzle of the cleaning plate are installed with the electromagnetic valves, and the transducer and the electromagnetic valve are connected via the signal transmission line and the central controller. The transducer is used for testing the water pressure in the nozzle of the cleaning gun and the high-pressure nozzle and transmitting water pressure signal data to the central controller. When the water pressure is lower than the preset value, the central controller controls the electromagnetic valve to reduce the water outlet to increase the water pressure; but when the water pressure is too high, the central controller controls the electromagnetic valve to enlarge the water outlet or mediate the control of the booster pump and the plunder pump to prevent from damaging the apparatus due to too high pressure.

The underwater cavitation jet cleaning system of this embodiment further comprises an automatic metering feeder 9 for cleaning solution, the automatic metering feeder 9 for cleaning solution is communicated with a water outlet of the plunger pump 5 through an infusion pipe, and the infusion pipe of the automatic metering feeder 9 for cleaning solution is installed with a one-way check valve; the automatic metering feeder 9 for cleaning solution is internally provided with the cleaning solution containing the following components: 1.0% of palm kernel oil fatty acid amide propyl betaine, 2.0% of coconut fatty acid diethanol amide, 1.0% of glycyrrhetinic acid stearate, 1.5% of dodecyl glucoside, 2.0% of sodium N-dodecyl-β-aminopropionate, 1.5% of N-acylamino acid, 2.0% of N-dihydroxyethyl dodecyl amide, 1.5% of sodium dodecyl allyl sulfosuccinate, 1.0% of sodium citrate, 1.0% of maleic acid 6.0% of ethanol, 3.0% of ethylene glycol, and the rest being water. A preparation method for the cleaning agent comprises the following steps.

(1) In an electric mixer, deionized water as well as palm kernel oil fatty acid amide propyl betaine and coconut fatty acid diethanol amide are put into a reaction kettle in proportion according to formula, and stirred until dissolving completely. Dodecyl glucoside, N-acylamino acid and sodium dodecyl allyl sulfosuccinate are added in the reaction kettle at a revolving speed of 400 rpm, heating to 40° C., and dispersing for 5 min.

(2) A mixed solution of ethanol and ethylene glycol is added into glycyrrhetinic acid stearate, and stirred until being dissolved completely at a revolving speed of 800 rpm.

(3) In an ice-cold bath condition, the solution of (1) and (2) is ultrasonically mixed, N-dihydroxyethyl dodecyl amide, sodium N-dodecyl-β-aminopropionate, sodium citrate and maleic acid are added, standing for 1 h.

A controller 10 is used for a human interactive interface. The automatic metering feeder 9 for cleaning solution and the power unit 2 are controlled by the controller 10 to operate respectively.

Embodiment 2

The main technical solution of this embodiment is basically the same as that of the embodiment 1. The features which are not explained in this embodiment use the explanation in the embodiment 1, which will not be elaborated herein. In this embodiment, the cleaning agent is composed of the following components: 3.0% of palm kernel oil fatty acid amide propyl betaine, 3.0% of coconut fatty acid diethanol amide, 3.0% of glycyrrhetinic acid stearate, 5.0% of dodecyl glucoside, 4.0% of sodium N-dodecyl-β-aminopropionate, 3.50% of N-acylamino acid, 6.0% of N-dihydroxyethyl dodecyl amide, 2.0% of sodium dodecyl allyl sulfosuccinate, 2.5% of sodium citrate, 2.0% of maleic acid, 12.0% of ethanol, 6.0% of ethylene glycol, and the rest being water. The difference between the preparation method for the cleaning agent and the embodiment 1 is as follows:

(1) the components are stirred at a revolving speed of 700 rpm, heated to 40° C. in the reaction kettle, and dispersed for 8 min;

(2) the component are stirred at the revolving speed of 1200 rpm until being dissolved completely; and (3) the component are stood for 1.5 h in an ice-cold batch condition.

Embodiment 3

The main technical solution of this embodiment is basically the same as that of the embodiment 1. The features which are not explained in this embodiment use the explanation in the embodiment 1, which will not be elaborated herein. The cleaning solution is composed of the following components: 2.0% of palm kernel oil fatty acid amide propyl betaine, 2.5% of coconut fatty acid diethanol amide, 2.0% of glycyrrhetinic acid stearate, 3.5% of dodecyl glucoside, 3.0% of sodium N-dodecyl-β-aminopropionate, 2.0% of N-acylamino acid, 4.0% of N-dihydroxyethyl dodecyl amide, 1.8% of sodium dodecyl allyl sulfosuccinate, 1.7% of sodium citrate, 1.5% of maleic acid, 9% of ethanol, 4.6% of ethylene glycol, and the rest being water. The difference between the preparation method for the cleaning agent and the embodiment is as follows:

(1) the components are stirred at a revolving speed of 550 rpm, heated to 40° C. in the reaction kettle, and dispersed for 6 min;

(2) the component are stirred at the revolving speed of 1000 rpm until being dissolved completely; and (3) the component are stood for 1.5 h in an ice-cold batch condition.

Wherein, the cleaning agent of the present invention is applied for experimental data of cavitation jet cleaning.

| Item | Microjet speed (m/s) | Microjet impact times Times/ (s · cm$^2$) | Cleaning speed Cleaning gun | Cleaning plate | Cleaning rate |
|---|---|---|---|---|---|
| Not adding cleaning agent | 180 | 850 | 150 | 630 | 92% |
| Embodiment 1 | 178 | 900 | 158 | 643 | 96% |
| Embodiment 2 | 170 | 950 | 165 | 657 | 98% |
| Embodiment 3 | 175 | 930 | 160 | 651 | 97% |

It should be finally noted that various embodiments above are merely employed to describe the technical solution of the invention, but are not intended to limit the protection scope of the claims. Those having ordinary skills in the art may understand and can make modifications or equivalent replacements to the technical solution of the present invention with reference to the preferable embodiments, which shall fall within the same essence and protection scope of the technical solution of the invention.

What is claimed is:

1. An underwater cavitation jet cleaning system, comprising a supporting structure, an automatic metering feeder for cleaning solution, a booster pump, a filter, a plunger pump and a high-pressure hose connected in sequence, wherein a water outlet end of the high-pressure hose is attachable to a cleaning gun or a cleaning plate; the automatic metering feeder for cleaning solution is communicated with a water inlet end of the plunger pump, and an infusion pipe of the automatic metering feeder for cleaning solution is installed with a one-way check valve, and the automatic metering feeder for cleaning solution is controlled by a central controller to operate respectively;

a sprayer of the cleaning gun is provided with a nozzle, the nozzle is opened with a diversion hole, the diversion hole comprises an inflow passage and an eddy segment, the eddy segment is arranged as a spiral passage, and the eddy segment is gradually tapered from a water inlet to a water outlet; crystallized silicon dioxide particles are dispersed on a surface of an inner wall of the nozzle, and the silicon dioxide particles are protruded out of the surface of the inner wall of the nozzle;

the sprayer of the cleaning gun is provided with a rotatable waterproof jacket, a miniature vibrator and a power supply are arranged in the waterproof jacket; and an organ pipe is arranged between the sprayer and a barrel of the cleaning gun;

one end of the barrel of the cleaning gun close to the sprayer is provided with an automatic heating unit, the automatic heating unit is composed of a temperature sensor, an electric hot plate and a microchip and is connected with the power supply;

an in-pipe passage of the barrel is formed by communicating a plurality of spherical chambers, a diameter of a connecting portion of two adjacent spherical chambers is smaller than a diameter of each the plurality of spherical chambers; and the cleaning plate comprises a hand-push frame, a shell, a hollow revolving shaft, an input pipe and a jet pipe, the hand-push frame is connected with the shell, the hollow revolving shaft is rotatably installed in the shell, the hollow revolving shaft is provided with a diversion passage and an inner wall of the diversion passage is provided with a plurality of strips, each of the plurality of strips is of arc-shaped, the high-pressure hose is assembled with and communicated with the input pipe, the input pipe is communicated with an upper portion of the diversion passage, a lower portion of the diversion passage is communicated with the jet pipe, and a bottom thereof is provided with another sprayer.

2. The underwater cavitation jet cleaning system according to claim 1, wherein a lower portion of the hollow revolving shaft is fixedly connected with a baffling hood, and the sprayer at the bottom of the hollow revolving shaft is located inside the baffling hood.

3. The underwater cavitation jet cleaning system according to claim 2, wherein an inner wall of the baffling hood is provided with a plurality of arc-shaped plates, and the plurality of arc-shaped plates are uniformly arranged along a periphery.

4. The underwater cavitation jet cleaning system according to claim 1, wherein the jet pipe is provided with a high-pressure nozzle, an included angle between the high-pressure nozzle and the jet pipe in a horizontal direction is 120° to 150°, and an included angle between the high-pressure nozzle and the jet pipe in a vertical direction is 130° to 170°.

5. The underwater cavitation jet cleaning system according to claim 4, wherein the shell is further provided with an ultrasonic generator, a plurality of jet pipes are provided, each jet pipe is provided with a flow control valve, and the plurality of flow control valves and the ultrasonic generator are controlled by the central controller to operate.

6. The underwater cavitation jet cleaning system according to claim 1, wherein a detachable grid network is arranged at a bottom of the shell of the cleaning plate.

7. The underwater cavitation jet cleaning system according to claim 1, wherein the automatic metering feeder for cleaning solution is internally provided with the cleaning solution containing the following components:

| | |
|---|---|
| palm kernel oil fatty acid amide propyl betaine | 1.0-3.0%, |
| coconut fatty acid diethanol amide | 2.0-3.0%, |
| glycyrrhetinic acid stearate | 1.0-3.0%, |
| dodecyl glucoside | 1.5-5.0%, |
| sodium N-dodecyl-β-aminopropionate | 2.0-4.0%, |
| N-acylamino acid | 1.5-3.5%, |
| N-dihydroxyethyl dodecyl amide | 2.0-6.0%, |
| sodium dodecyl allyl sulfosuccinate | 1.5-2.0%, |
| sodium citrate | 1.0-2.5%, |
| maleic acid | 1.0-2.0%, |
| ethanol | 6.0-12%, |
| ethylene glycol | 3.0-6.0%, and |
| the remaining being water. | |

* * * * *